US006350941B1

(12) United States Patent
Miller et al.

(10) Patent No.: US 6,350,941 B1
(45) Date of Patent: Feb. 26, 2002

(54) HAND DRUM HOOP

(75) Inventors: Robert O. Miller, W. Babylon; James D'Addario, Old Westbury, both of NY (US)

(73) Assignee: J. D'Addario & Company, Inc., Farmingdale, NY (US)

( * ) Notice: Subject to any disclaimer, the term of this patent is extended or adjusted under 35 U.S.C. 154(b) by 0 days.

(21) Appl. No.: 09/484,624

(22) Filed: Jan. 18, 2000

(51) Int. Cl.[7] ..... G10D 13/02
(52) U.S. Cl. ..... 84/411 R; 84/413; 84/411 A
(58) Field of Search ..... 84/411 R, 412, 84/413, 414, 411 A, 419

(56) References Cited

U.S. PATENT DOCUMENTS 4,779,508 A * 10/1988 Beals ..... 84/414
5,554,812 A * 9/1996 Donohoe ..... 84/413

* cited by examiner

*Primary Examiner*—Shih-Yung Hsieh
(74) *Attorney, Agent, or Firm*—Alix, Yale & Ristas, LLP

(57) ABSTRACT

A drum hoop having an asymmetrical cross section for use in combination with hand drums. The drum hoop upper inner edge is connected to a lower inner edge having a larger diameter producing a drum hoop inner surface having an angular orientation to the central axis of the drum. The angular orientation of the inner surface maximizes clearance between the drum hoop and the variable diameter exterior surface of the drum shell. Added clearance allows a drum hoop constructed according to the invention to accommodate variations in exterior surface diameter often encountered in hand made drum shells common in the art.

12 Claims, 3 Drawing Sheets

HAND DRUM HOOP

BACKGROUND OF THE INVENTION

This invention relates generally to the field of musical drums and is more particularly directed to a drumhead and associated drum hoop. The drum hoop is specifically adapted to be used in conjunction with hand drums.

Hand drums refer to musical drums that are usually played with the hand instead of with sticks, e.g., conga, bongo, djembe and bata drums. Hand drums have a generally cylindrical drum shell, typically constructed of wood, which has an open top and bottom. Shells for hand drums, such as conga drums, frequently have a shape which is larger around the middle and tapered toward the top and bottom openings. The top opening is usually covered with an animal skin drumhead tightened and tuned to a desired musical tone. Traditionally, such animal skins were tightened over the top of the wooden drum shell by the use of rawhide binding strips, twine or rope, producing a drum and head assembly not easily tuned or modified. While natural skin drumheads produce beautiful musical tones, they are also very sensitive to atmospheric changes such as heat and humidity. Large changes in temperature or humidity can dramatically change the musical tone of a natural skin drum head and render drums so equipped unplayable.

To address these disadvantages, musical instrument makers have developed synthetic drumheads closely approximating the musical characteristics of traditional skin drumheads. Synthetic drumheads are constructed from sheets of synthetic material joined to a drum hoop and formed to fit over the open top of a drum shell. The drum hoop is sized to pass over the open top end of a drum shell and be drawn toward the bottom of the drum shell by a counterhoop and tensioning mechanisms. Using such an arrangement makes changing drumheads and tuning of hand drums relatively quick and easy.

Being a traditional instrument in many cultures, hand drums are often constructed by hand, resulting in significant variations in the size of the outside diameter of the drum shell and the slope of the taper of the drum shell. As a drum hoop is drawn over the top of a drum shell toward the bottom of the drum shell for tuning purposes, clearance must be maintained between the exterior surface of the drum shell and the inner surface of the drum hoop. Contact between the hoop lower inner edge and the exterior surface of the drum shell will interfere with hoop movement, making tuning the drum impossible.

Conventional manufactured drum hoops for hand drums are constructed from a symmetrical U-shaped metal channel into which the peripheral edge of a synthetic drumhead is secured by use of a glue or resin. Uniformly sized, symmetrically shaped manufactured drum hoops often fail to provide sufficient clearance to accommodate the size and taper variations found in hand made hand drum shells and therefore cannot be used.

SUMMARY OF THE INVENTION

The present invention is directed to a uniquely configured drum hoop which has an asymmetrical cross section and an angled lower inner surface to maximize the available clearance between the lower inner surface of the drum hoop and the exterior surface of a hand drum shell.

According to a general aspect of the present invention, a hand drum hoop has an angled inner surface connecting an upper inner edge with a lower inner edge having a larger diameter so that the inner surface angles away from the exterior surface of the hand drum shell. Such a construction maximizes available clearance between the drum hoop and the hand drum shell, especially in synthetic drumhead/manufactured drum hoop combinations on hand drums which vary in size and configuration.

The drum hoop is preferably constructed from extruded material formed into an annular channel having a diameter sized for a particular type of drum. The annular space enclosed by the channel of the drum hoop will accommodate insertion of the peripheral edge of the drumhead sheet and resin to secure the drumhead sheet to the drum hoop.

An object of the present invention is to provide an new and improved hand drum hoop which will accommodate variations in size of the hand drum shell.

Another object of the present invention is to provide a new and improved hand drum hoop which will allow the use of synthetic drum heads on a wide variety of handmade hand drums.

A further object of the invention is to provide a new and improved hand drum hoop utilizing modern manufacturing methods which is compatible with handmade hand drum shells.

These and other objects, features and advantages of the invention will become readily apparent to those skilled in the art upon reading the description of the preferred embodiments in conjunction with the accompanying drawings.

DETAILED DESCRIPTION OF THE PREFERRED EMBODIMENT

Figure 1:
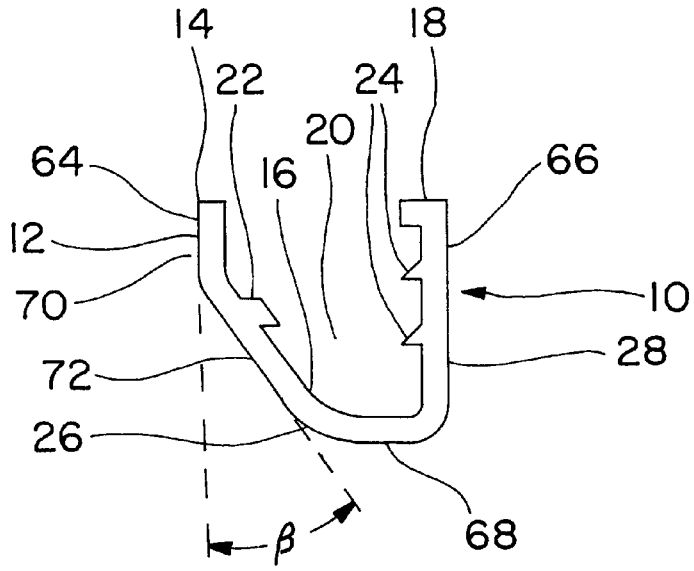
FIG. 1 is a schematic cross-sectional view of a drum hoop constructed according to the present invention.

Referring now to the drawings in more detail and initially to FIG. 1, a drum hoop 10 constructed according to the present invention is shown in cross section. The drum hoop 10 may be constructed of extruded material and has an asymmetrically U-shaped cross section. Aluminum is a preferred material due to its rigidity, appearance and other properties. The cross section of FIG. 1 can be contrasted with the prior art drum hoop cross section illustrated in FIG. 2. The drum hoop 10 of FIG. 1 has an upper inner edge 14, an upper outer edge 18, and a lower inner edge 26. An interior surface 16 connects the upper inner and upper outer edges and defines an interior space 20. Upper inner 14 and lower inner 26 edges are connected by inner surface 12. (As used in this application, "inner surface" means the surface of a drum hoop which is adjacent the exterior surface of a drum shell when the hoop is installed over a drum shell.) Upper inner edge 14 has a first diameter and lower inner edge 26 has a greater second diameter. In a preferred embodiment, inner surface 12 takes the form of a substantially conical annular surface having an angular orientation g to a central axis.

The cross section of drum hoop 10 illustrated in FIG. 1 can alternatively be described in terms of an inner leg 64, an outer leg 66 and a connecting portion 68 joining the inner and outer legs in a radially spaced relationship. The inner leg 64 begins at the upper inner edge 14, has a vertical portion 70 parallel to the central axis A and an angled portion 72 including an annular barb 22 and ends at the lower inner edge 26. The connecting portion 68 joins the lower inner edge of the inner leg 64 to the outer leg 66. The outer leg 66 begins at the upper outer edge 18 which forms a lip projecting toward the upper inner edge 14 and extends to the juncture with the connecting portion 68. The outer leg 66 is substantially parallel to the central axis A and has annular barbs 24 projecting into the annular interior space 20 defined by the drumhead hoop 10.

Figure 3:
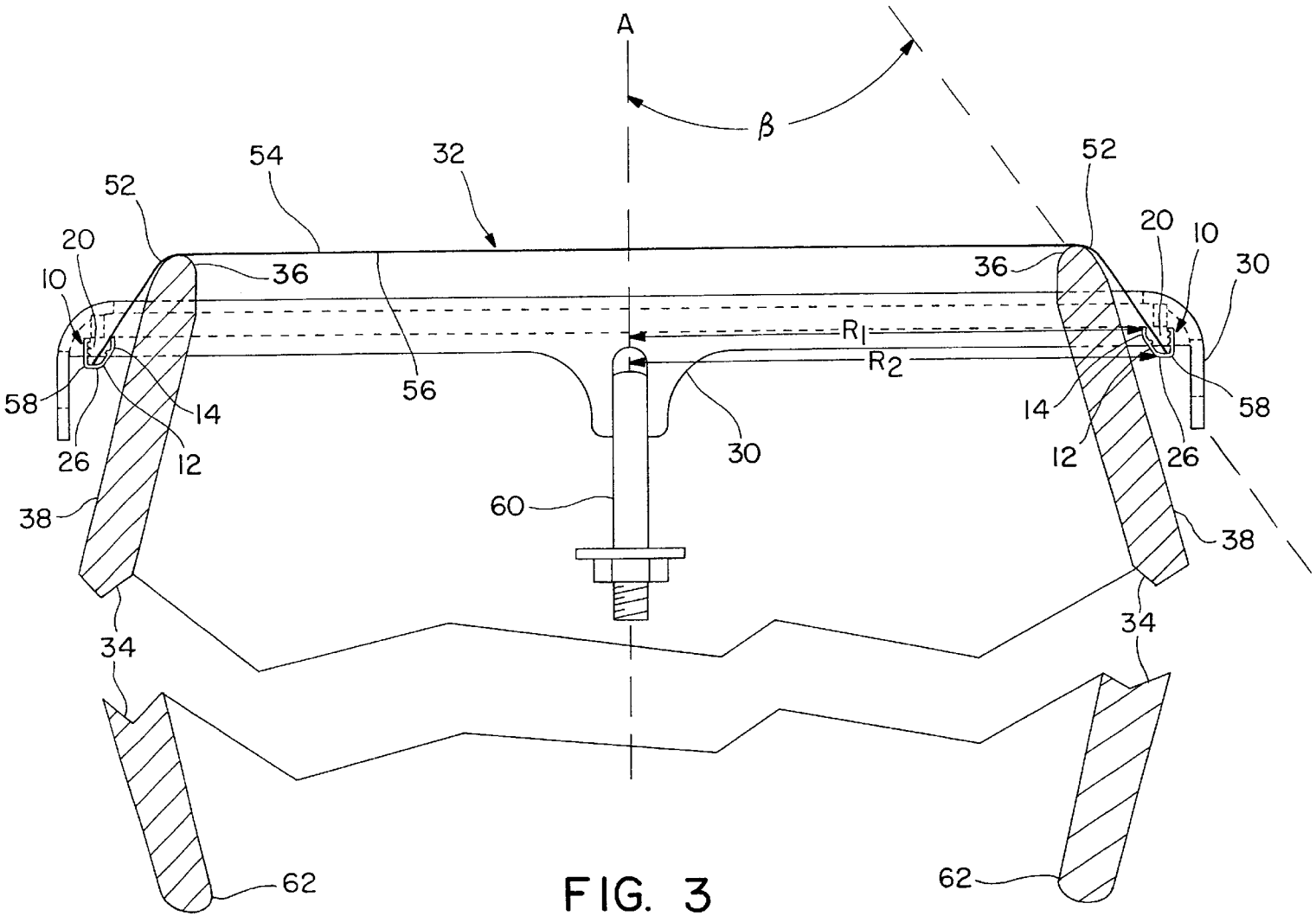
FIG. 3 is a cross-sectional view, partly in phantom, of a drum shell (partially illustrated), a drumhead consisting of a drumhead sheet and drum hoop constructed according to the present invention and a counter-hoop in an installed configuration.

Referring now to FIG. 3, which illustrates a cross sectional view of a hand drum utilizing a drum hoop 10 constructed according to the present invention, the peripheral edge 58 of a drumhead sheet 32 is affixed within the annular interior space 20 of a drum hoop 10 forming a drumhead. The assembled drumhead sheet 32 and drum hoop 10 are placed over a first end 52 of a drum shell 34. A counter hoop 30 is placed over the first end 52 of the drum shell 34 and engages the drum hoop 10. Tensioning means 60 engage counter hoop 30 and draw the counter hoop 30 and drum hoop 10 toward the second end 62 of the drum shell 34 creating tension in the drumhead sheet 32 between the bearing areas 36 of the drum shell 34.

FIG. 3 illustrates the physical relationships between the interior surface 12 of the drum hoop 10 and the tapered exterior surface 38 of the drum shell 34. The exterior surface 38 of the drum shell 34 is of variable diameter. Many hand drum shells are produced by hand and have exterior surfaces 38 which vary in their diameter and in their angular orientation to the drum central axis A.

Frequently, a prior art drum hoop 40 (illustrated in FIG. 2) would fail to provide sufficient clearance between that hoop's inner surface 42 and the exterior surface 38 of the drum shell 34 causing physical contact which interferes with tuning and use of the drum. The present invention provides much needed additional clearance between the interior surface 12 of the drum hoop 10 and the exterior surface 38 of the drum shell 34 by providing a lower inner edge 26 of the drum hoop 10 having a greater diameter than the upper inner edge 14 of the drum hoop 10.

Figure 4:
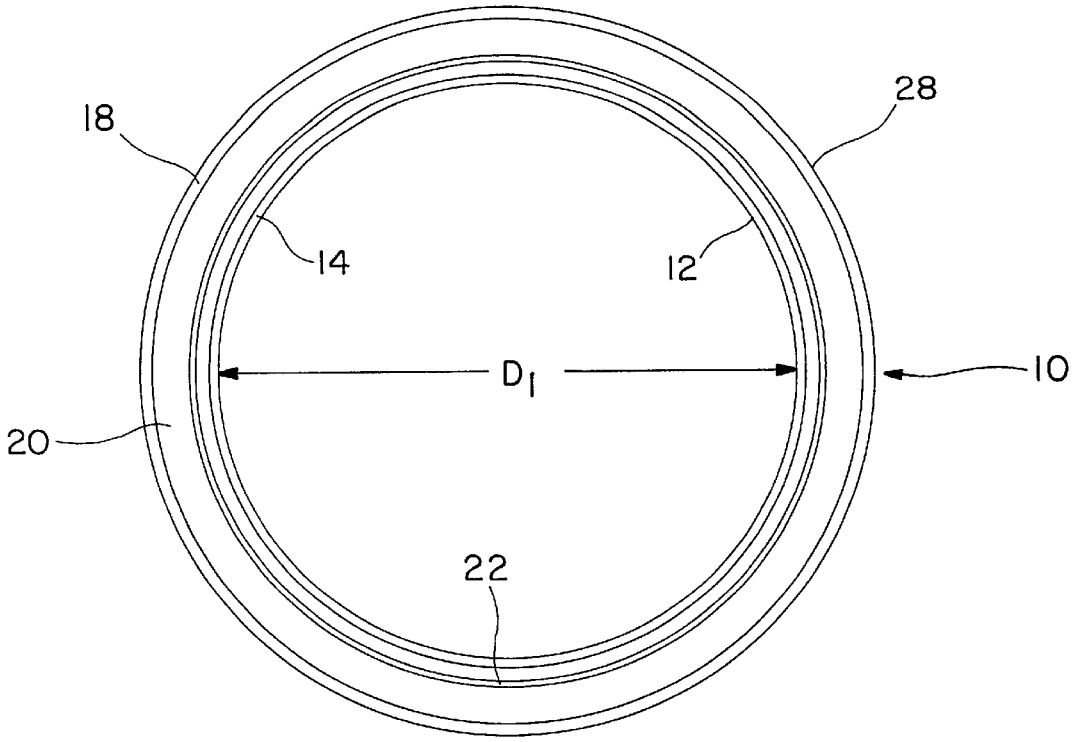
FIG. 4 is a schematic top view of the drum hoop of FIG. 1.
Figure 5:
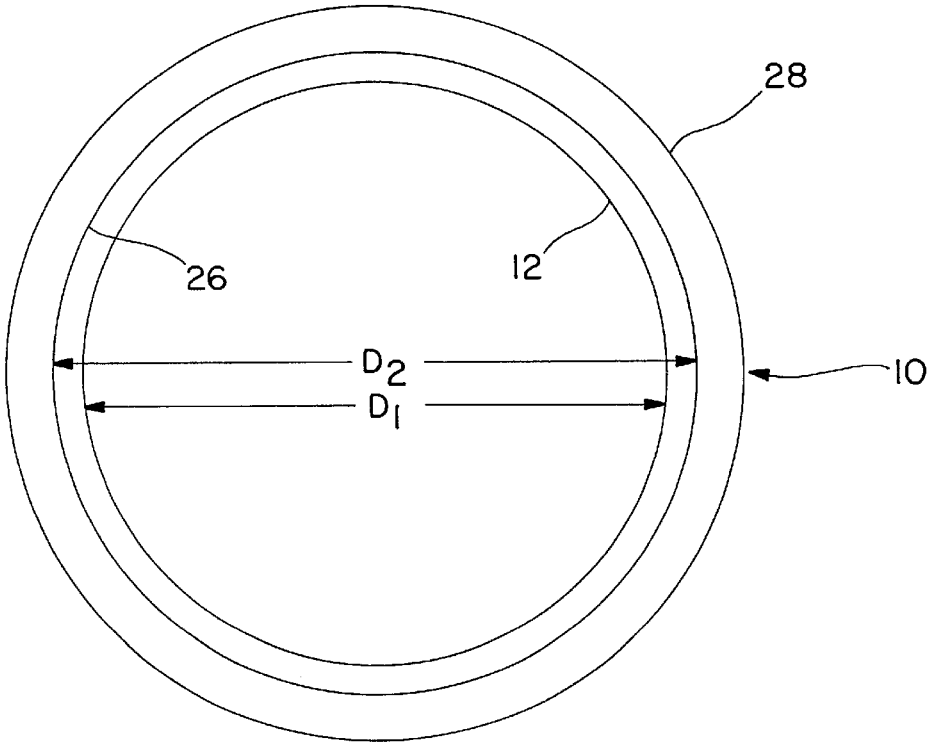
FIG. 5 is a schematic bottom view of the drum hoop of FIG. 1.

In the preferred embodiment illustrated in FIGS. 4 and 5, the larger diameter $D_2$ of the lower inner edge 26 induces an angular orientation to the inner surface 12 connecting the upper inner 14 and lower inner 26 edges. According to a preferred embodiment illustrated in these figures, the angular orientation of the inner surface 12 to the central axis A which is represented by the symbol β in FIGS. 1 and 3. β for the illustrated preferred embodiment is approximately 35 degrees. However, an acceptable range for β is between 20 and 60 degrees.

When installed adjacent to the exterior surface 38 of a drum shell 34 the angled orientation of the inner surface 12 of a drum hoop 10 can be seen in FIG. 3 to produce additional clearance between the drum hoop 10 and the outer surface 38 of the drum shell 34. This additional clearance is represented by radii $R_1$ between central axis A and upper inner edge 14 and $R_2$ between central axis A and lower inner edge 26, $R_2$ being greater than $R_1$.

Figure 2:
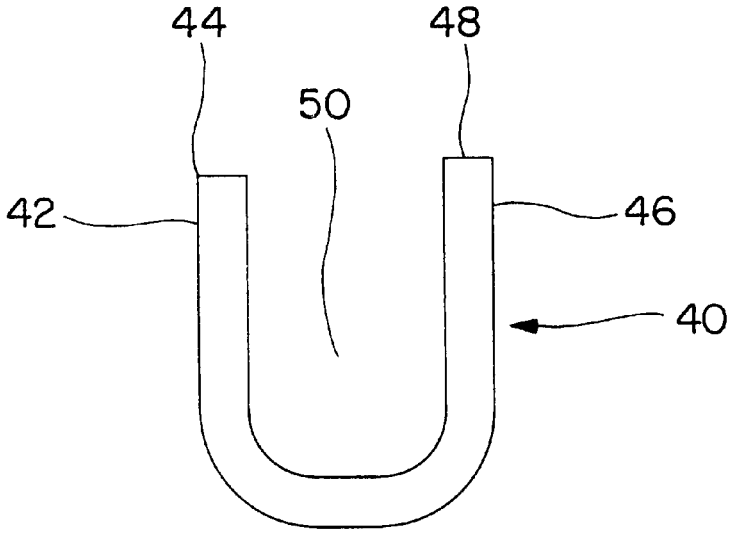
FIG. 2 PRIOR ART
FIG. 2 is a schematic cross-sectional view of a prior art drum hoop.

Referring now to FIG. 2, it can be seen that the symmetrical configuration of the prior art drum hoop 40 as illustrated produces an inner surface 42 parallel to central axis A and would provide no extra clearance between the prior art drum hoop 40 and the exterior surface of a drum shell.

Referring now to FIGS. 4 and 5 which are schematic top and bottom views, respectively, of a drum hoop 10 constructed according to the present invention. (It should be noted that these figures are not drawn to scale. The dimensions of the drum hoop 10 are exaggerated with respect to the hoop diameter for clarity.) FIG. 4 is a schematic top view of a preferred embodiment of a drum hoop 10 constructed according to the present invention. The drum hoop 10 has an upper inner edge 14 having a first diameter $D_1$ and an upper outer edge 18. The inner surface 12 connects to the outer surface 28 at the lower inner edge 26. (This junction is illustrated in FIG. 5.) Looking into the annular interior space 20 from above, an annular barb 22 can be seen. As also illustrated in FIG. 1, the annular barb 22 is located on the interior surface of the angled portion of the drum hoop and so is shown in it's axially outwardly displaced position.

FIG. 5 is a bottom schematic view of a preferred embodiment of a drum hoop 10 constructed according to the present invention. Inner surface 12 and outer surface 28 are shown meeting at lower inner edge 26. FIG. 5 also illustrates diameter $D_1$ of the upper inner edge in contrast to greater diameter $D_2$ of the lower inner edge 26. In the preferred embodiment illustrated in FIGS. 1 and 3–5, inner surface 12 forms a substantially conical surface having an angular orientation β to the central axis A.

A preferred embodiment illustrated in FIG. 1 also contains annular barbs 24 and an overhanging upper inner edge 18 which work in conjunction with annular barb 22 to engage and retain the resin (not illustrated) used to secure the peripheral edge 58 of drum head sheet 32 in the annular interior space 20 of the drumhead hoop 10.

A drum hoops constructed according to the present invention will be substantially rigid and have diameters ranging from 6 inches to 2 feet depending on the size of the drum shell. The span of the annular channel defined by the upper inner and upper outer edges of drum hoops constructed according to the present invention will be in the range of ¼ to 1 inch, depending on the size of the drum shell and the material used for the drum hoop and the drumhead sheet. The angular orientation of the inner surface to a central axis may be in the range of 20 to 60 degrees but is preferably closer to 35 degrees.

Other modifications and alternative embodiments of the invention will be apparent to those skilled in the art in view of the foregoing description. This description is to be construed as illustrative only and is for the purpose of teaching those skilled in the art the best mode of carrying out the invention. The details of the structure and method may be varied substantially without departing from the spirit of the invention, and the exclusive use of all modifications which come within the scope of the appended claims is reserved.

What is claimed is:

1. A drumhead for use in conjunction with a drum shell comprising:

a drumhead sheet having a top surface and a bottom surface, a central axis perpendicular to said surfaces, said sheet terminating in a peripheral edge;

a drumhead hoop coaxially aligned with said sheet and having a hoop axial height, an annular upper inner edge at a first diameter and an annular lower inner edge at a greater second diameter and an inner surface connecting said upper inner edge to said lower inner edge, said inner surface comprising a first portion parallel to said central axis and a second portion, said second portion defining a conical surface extending between said first portion and said lower inner edge having a constant angular orientation β to said central axis and an axial height of at least one half the hoop axial height; and means for securing said drumhead sheet peripheral edge to said hoop.

2. The drumhead as in claim 1, wherein said constant angular orientation β is in the range of 20–60 degrees.

3. The drumhead as in claim 1, wherein said drumhead hoop has an asymmetrical cross section and an interior surface defining an annular interior space, and said means for securing the drumhead sheet is within said interior space.

4. The drumhead as in claim 3, wherein said drumhead hoop interior surface comprises at least one annular barb projecting into said interior space.

5. The drumhead as in claim 1, wherein said hoop has an upper outer edge connected to said upper inner edge by an interior surface, said upper outer edge forming an annular lip protruding toward said upper inner edge.

6. In a hand drum of the type having a central axis, a coaxial generally cylindrical drum shell having a variable diameter exterior surface connecting first and second axially spaced ends of the shell, a drumhead located at the first end of the shell including a drumhead sheet having a peripheral edge joined to a drum hoop at said peripheral edge, a counterhoop and tensioning means, wherein said counterhoop engages said drum hoop and said tensioning means, whereby said counterhoop is pulled along said central axis toward said second end by said tensioning means, stretching said drumhead sheet over said first end, the improvement comprising;

said drum hoop having an upper inner edge having a first diameter, a lower inner edge having a greater second diameter and an inner surface connecting said upper inner and lower inner edges, said inner surface comprising an upper portion parallel to said central axis and a conical inner surface portion connecting said upper portion to said lower inner edge, said conical inner surface portion facing said drumshell exterior surface and having a constant angular orientation β to said central axis.

7. The improved drum as in claim 6, wherein said constant angular orientation β is between 20° and 60°.

8. A drum hoop for use in conjunction with a drum having a central axis, a drum shell and a drumhead, said drumhead having a drumhead sheet terminating in a peripheral edge, wherein said peripheral edge is securable to the drum hoop, wherein the drum hoop comprises;

a ring having an asymmetrical cross section with a conical inner surface portion extending between an upper inner surface portion having a constant first diameter relative to said central axis and a lower inner edge having a greater second diameter, said conical inner surface portion having a constant angular orientation β to said central axis, and an upper outer edge, said upper inner and upper outer edges defining an opening to an annular interior space which is further defined by said hoop concave interior surface.

9. A drum hoop as in claim 8, wherein said constant angular orientation β is between 20° and 60°.

10. A drum hoop as in claim 8 wherein said interior surface comprises at least one annular barb projecting into said annular interior space.

11. A drum hoop as in claim 8 wherein said upper outer edge comprises a lip protruding toward said upper inner edge.

12. A drum hoop as in claim 8, wherein said ring asymmetrical cross section includes;

an interior leg beginning at said upper inner edge and comprising said upper portion and said conical inner surface portion, said constant angular orientation β being approximately 35°, said interior leg including at least one annular barb projecting into said annular interior space, a connecting portion substantially perpendicular to said axis, and a radially spaced outer leg beginning at said upper outer edge and extending, substantially parallel to said axis, to said connecting portion, said outer leg including at least one annular barb projecting into said interior space and a lip projecting from said upper outer edge toward said upper inner edge;

said connecting portion joining said inner and outer legs in a radially spaced relationship.

* * * * *